US011772059B1

(12) United States Patent
Edwards

(10) Patent No.: US 11,772,059 B1
(45) Date of Patent: Oct. 3, 2023

(54) MIXING DEVICE, SYSTEM AND METHOD OF MIXING

(71) Applicant: Thomas Joseph Edwards, Bangor (GB)

(72) Inventor: Thomas Joseph Edwards, Bangor (GB)

( * ) Notice: Subject to any disclaimer, the term of this patent is extended or adjusted under 35 U.S.C. 154(b) by 0 days.

(21) Appl. No.: 17/744,836

(22) Filed: May 16, 2022

(30) Foreign Application Priority Data

May 3, 2022 (GB) ..... GB2206410.9

(51) Int. Cl.
*B01F 31/23* (2022.01)
*B01F 31/50* (2022.01)
*B01F 31/20* (2022.01)

(52) U.S. Cl.
CPC ..... *B01F 31/23* (2022.01); *B01F 31/201* (2022.01); *B01F 31/265* (2022.01); *B01F 31/50* (2022.01)

(58) Field of Classification Search
CPC ..... B01F 31/23; B01F 31/201; B01F 31/50; B01F 31/25; B01F 31/265
See application file for complete search history.

(56) References Cited

U.S. PATENT DOCUMENTS 3,061,280 A * 10/1962 Kraft ..... B01F 35/422 74/18.1
3,128,082 A * 4/1964 Cline ..... B01F 35/421 366/128
3,623,706 A * 11/1971 Isaacson ..... B01F 31/60 366/186
3,637,190 A * 1/1972 Isaacson ..... B01F 31/60 451/326
3,643,384 A * 2/1972 Isaacson ..... B06B 3/00 451/326
5,642,938 A * 7/1997 Nakagawa ..... B01F 31/265 366/209

(Continued)

FOREIGN PATENT DOCUMENTS

CN 106139985 * 11/2016
CN 106732096 * 12/2016

(Continued)

*Primary Examiner* — Charles Cooley

(57) ABSTRACT

A mixing device comprising a multi-element spring system in which an eccentric load, coupled to a rotor of a motor, is located towards a first end of a first beam realising a backbone for the mixing device. One or more connections interconnect the backbone respectively to one or more other beams to produce the multi-element spring system. A load, such as a vial or other container in which is located a diluent, is located remotely from the motor. As such, the spring system supports two independent but complementary eccentric load generating subsystems arising from, respectively, the controlled rotation of the rotor (and its eccentric load) and then, in response to rotation of the connected eccentric load on the rotor, swirling of the diluent in the vial/container. Both these eccentric loads contribute to a complex multidirectional flexing of the multi-element spring system relative to a fixed anchor point, with this multidirectional flexing working to induce a swirling motion in the contents of the container.

22 Claims, 11 Drawing Sheets
(7 of 11 Drawing Sheet(s) Filed in Color)

(56) References Cited

U.S. PATENT DOCUMENTS 5,947,594 A * 9/1999 Dolatli ..... B01F 31/201 366/209
5,971,599 A * 10/1999 Bothers ..... B01F 31/24 366/110
6,039,557 A * 3/2000 Unger ..... A61K 41/0052 366/208
7,188,994 B2 * 3/2007 Poo ..... B01F 31/50 366/187
8,017,094 B2 * 9/2011 Meyer ..... B01F 31/25 422/561
8,899,821 B2 * 12/2014 Herz ..... B01F 31/22 366/209
9,339,779 B1 * 5/2016 Olson ..... B01F 31/265
9,802,170 B2 * 10/2017 Endo ..... B01F 35/211
2001/0030906 A1 * 10/2001 Friedman ..... C12M 27/16 366/127
2006/0093529 A1 * 5/2006 Meyer ..... B01L 9/06 422/400
2007/0145067 A1 * 6/2007 Headlee ..... B01F 35/7548 222/161
2011/0086432 A1 * 4/2011 Herz ..... B01F 31/201 422/68.1
2016/0089644 A1 * 3/2016 Endo ..... B01F 31/20 366/110
2023/0136755 A1 * 5/2023 Xue ..... B01F 31/201

FOREIGN PATENT DOCUMENTS

CN 111366443 * 4/2020
CN 111366443 A * 7/2020
CN 112354438 * 12/2020
CN 114558488 * 12/2020
CN 215877456 * 6/2021
DE 1913374 A1 * 3/1969
DE 2941421 A * 4/1981 ..... B01F 11/0025
GB 992002 A * 5/1961
GB 1057877 A * 10/1962
GB 2610674 A * 3/2023 ..... B01F 31/20
JP 9-52039 * 2/1997
WO WO-2005077511 A1 * 8/2005 ..... B01F 11/0025
WO WO-2008103004 A1 * 8/2008 ..... B01D 11/0062

* cited by examiner

| | A | B | C | D | E | F | G | H | I | J | K | L-L'' | M |
|---|---|---|---|---|---|---|---|---|---|---|---|---|---|
| All measurements are in mm and approximate except J in grams | ~1.5 | ~1.5 | ~2.5 radius | ~2.5 radius | ~50 | ~25 | ~25 | ~40 | ~25 | ~35g | Clockwise rotation | Variable decrease ,~20 to near 0 mm | ~30 |

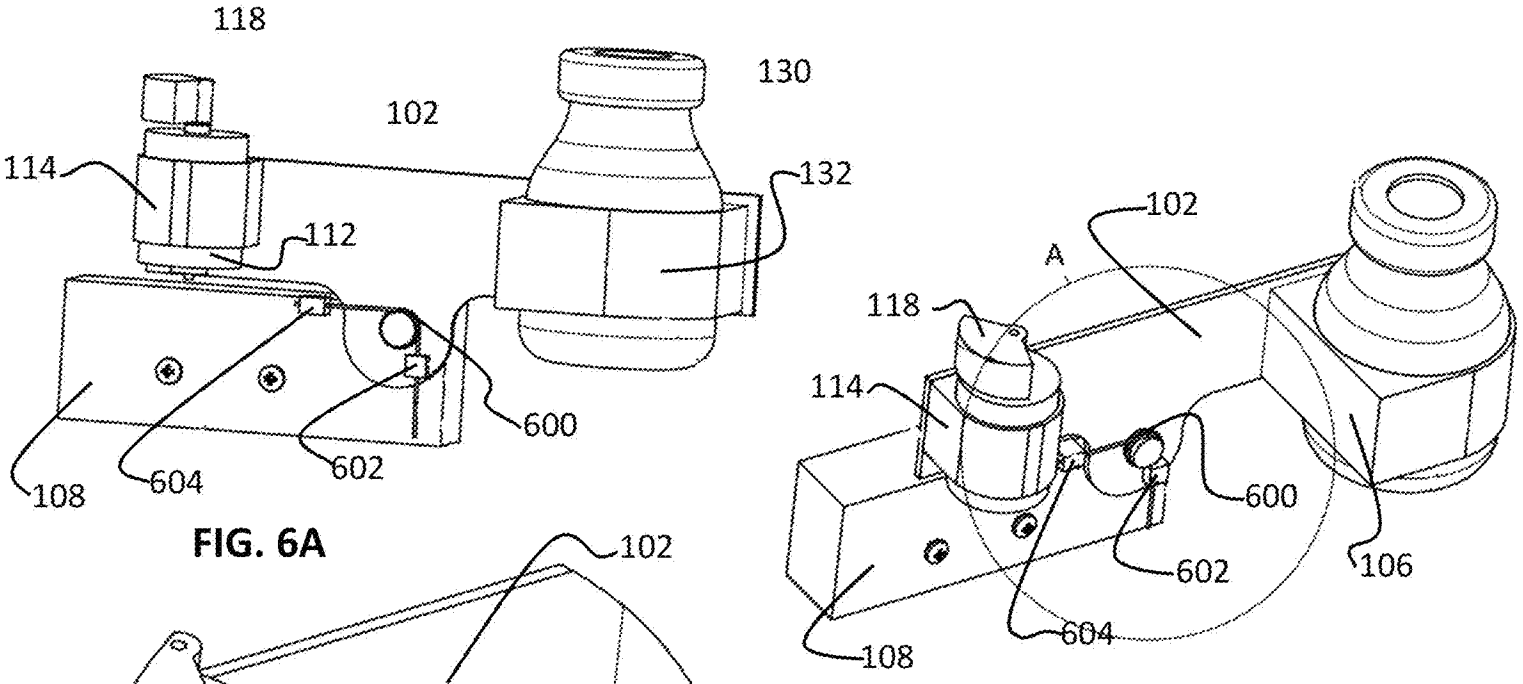
FIG. 6A
FIG. 6B
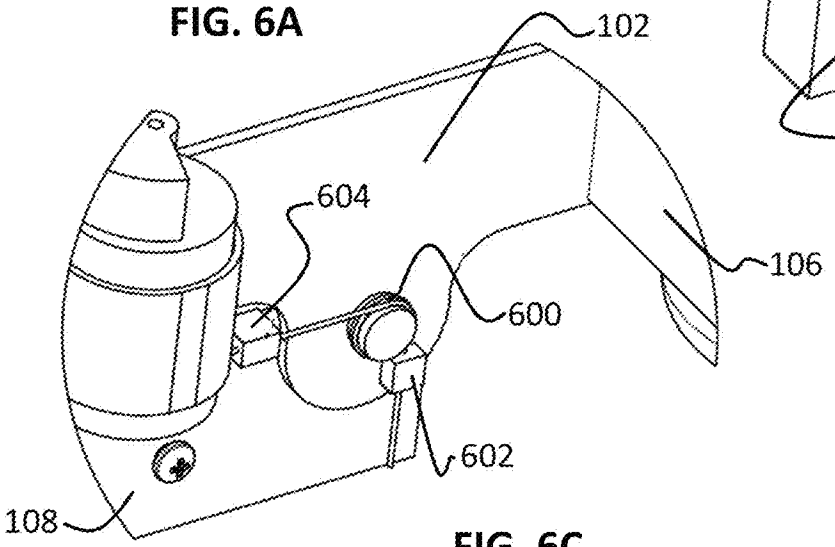
FIG. 6C

Return to approximate new orbit (time t1)

(time t2>t1)

(time t3>t2)

(time t4>t3)

(time t5>t4)

MIXING DEVICE, SYSTEM AND METHOD OF MIXING

FIELD OF THE INVENTION

This invention relates, in general to a mixing device and method of mixing. More particularly, but not exclusively, the invention relates to a mixer for mixing solids and liquids or for reconstitution, especially in the context of preparing pharmaceutical preparations in which a diluent is introduced into a vial containing a sterile compound, such as a crystalline or powdered form, requiring homogeneous mixing for sometimes just-in-time 'water clear' dissolution. However, the present invention has wider applications, especially for relatively small-volume mixing (including dissolving, diluting or suspending) and irrespective of whether base ingredients are in liquid into liquid or otherwise, and finds applications in household mixers for cosmetics, such as nail varnishes, tattoo inks and the like, food mixing (such as needed in the preparation of nutritional drinks or liquid mixable supplements), and also in veterinary science for the preparation of medicaments.

SUMMARY OF THE PRIOR ART

As it is known, drugs are frequently stored in powdered form (lyophilized) because they may rapidly degrade and consequently lose their efficacy once they are mixed into a solution. Powdered drugs are typically used for parenteral administration. These powdered drugs or medicines are often labelled to as "Powder for solution for infusion" and "Powder for solution for injection". Additionally, orally administered medicines are often liquid/solid suspensions within which ingredients settle or otherwise separate over time during storage.

The above powdered drugs need to be mixed in a container (normally a vial) with a liquid generally referred to as "the diluents", i.e., reconstituted. The above liquid suspension medicines often require manual mixing to homogenise or dissolve the medicine before administration.

Once the diluent has been added to the powdered drug, the liquid-powder mixture needs to be agitated in the container until the drug powder is dissolved, i.e., the reconstitution process is complete. For instance, the United States Pharmacopoeia "USP" [2006] defines completeness of reconstitution as the state where the solid dissolves completely, leaving no visible residue as un-dissolved matter or the constituted solution is not significantly less clear than an equal volume of the diluent or purified water present in a similar vessel and examined under similar conditions.

For medicines in suspension form, there is generally an instruction to "shake well before use" without a means of inspection of completeness of mixing, or if there are specific movements required to achieve acceptable mixing. For medicines and drugs delivered by spray a similar general "shake well before use" is often included in the instructions, but this instruction is itself subjective so can be interpreted differently by different people or otherwise it may be ignored.

Currently available solutions to the problem of effective mixing, whether in drug reconstitution [as is used as a particular example throughout this description] or for other products requiring mixing industrially or at home, are either focused on automated system whose aim is to optimize the agitation process to achieve the best dissolution and/or mixing for drug reconstitution in the shortest time, or otherwise are manual in nature.

Automated/mechanical systems available on the market perform agitation using the following movements:

- rotating the container around its longitudinal axis;
- rotate the container around a central axis of a rotating disk where the container has their longitudinal axis parallel or inclined or orthogonal to such rotation axis;
- shaking container with variable frequency or with variable amplitude; and
- inducing a vortex within the diluents by means of a mixing tool immersed in the diluents.

Manual mixing methods, such as shaking and swirling, are often performed by a person, such as a nurse or pharmacist technician. The time to achieve effective mixing could take from few seconds to several minutes. A person would not be able to manually repeat a complex movement for such a long time to achieve a consistent result and in a readily repeatable manner Indeed, the subjective nature of mixing, even by a professional healthcare worker, can or does result in a possibility for poor distribution of the active medicinal ingredients prior to administration to the patient.

Indeed, current practices relating to the preparation of medicaments, especially for just-in-time pharmaceuticals, are unreliable and/or labour intensive and, in fact, have several specific issues associated with production of an effectively mixed preparation.

For example, sterility of the components of the medicament, whether liquid or solid or a mixture, must be maintained. This means that vials are preferably permanently sealed, and a diluent introduced through seal penetration to avoid air exposure rather than by opening. Magnetic or physical mixing approaches in which respectively a magnetic stirrer or rod is introduced into the vial are each further frowned upon for reasons that the stirrer/rod is a foreign body and an additional cost item, and both potentially compromise sterility depending upon how the foreign body was prior treated or introduced.

In some instances, the mixing of certain drugs is frequently if not entirely conducted by hand because there is no effective mixer on the market. Such hand mixing is a specialised skill requiring: (a) mastery to produce the requisite swirling technique in the vial contents, (b) physical stamina, and (c) diligence. To provide a contextual example, the drug Tazozin® is notoriously difficult to mix and takes more than ten minutes to mix to a "water clear" state in which there are no visually identifiable particulates. Such human processing can lead to (a) repetitive strain injury, and/or (b) sub-optimal mixing and thus (c) sub-optimal dosing arising from a lack of objectivity in production. At least some of these mixing issues result in questions surrounding reconstituted drug efficacy and thus patient outcome issues.

The time-consuming nature of by-hand drug reconstitution is exacerbated by a lack of staff, while the costs associated with ineffectual and/or inefficient manual mixing are considerable. Neither of these problems lead to value-based healthcare.

The need for "just-in-time" drug reconstitution requires local, time-critical drug reconstitution. This requires a trained healthcare worker to be on hand, and that is not always possible because of the time of day or the location where reconstitution is required.

WO 05/077511 essentially relates to a "wobble table" supported by four sprung legs.

DE 2941421 relates to a paint mixer in which a paint tin is held in place on an oscillating plate by magnets. The up and down movement produced by this device does not suggest or indicate that it is capable of producing a mixing vortex.

U.S. Pat. No. 3,637,190 relates to an open, non-sterile system that deburs/polishes work pieces within a drum. This follows, for example, from col. 2, lines 18 to 24, namely "a chamber 35 . . . is adapted to receive . . . a media M of ceramic chips or other abrasive materials and a suspended batch of parts P which are to be surface finished such as by a deburring, polishing or descaling operation". The fact that the system employs coil springs and spring beams to attain a resonant frequency of oscillation with changes in the load. U.S. Pat. No. 3,623,706 is related to U.S. Pat. No. 3,637,190.

U.S. Pat. No. 3,643,384 is again related to U.S. Pat. No. 3,637,190. The subject-matter of U.S. Pat. No. 3,643,384 describes a large trough for deburring large-scale items, such as aircraft wings (see col.1, lines 4 to 8). The trough is configured, with spring biasing, to be shaken/vibrated. GB 992002 is another deburring machine in the form of a trough-based vibrator, as can be seen from FIG. 6 of that document.

DE 1913374 relates to a system for polishing and potentially cleaning rather than mixing.

FIGS. 4 to 8 of DE 1913374 establish that the system is not a sealed via, but rather a lid-clamped system on a rotating table driven by a motor with an eccentric load (elements 7 and 9).

US 2006/093529 granted as U.S. Pat. No. 8,017,094 is a biological sample analyser that operates on the premise of shaking.

CN 112354438 relates to a sieving of flour, as shown in FIGS. 4 and 5 of that document.

An efficient mixing device and related method for effectively constituting or reconstituting drugs or, more generally, mixing device that achieves effective mixing of other commodities, such as household paints, varnishes, food products and the like, in a consistent and repeatable manner is needed.

SUMMARY OF THE INVENTION

According to a first aspect of the invention there is provided a mixing device comprising: a rotating actuator carrying an eccentric load; a controller exercising parameter control defining operation of the rotating actuator and instantaneous amounts of energy provided, at least in part, to the mixing device through controlled rotation of the eccentric load; a mount configured to hold securely the rotating actuator; a clamp configured to hold a mixing container representing a mass, wherein the mixing container includes at least one liquid as part of assembled container contents; a multi-element spring containing a plurality of conjoined beams each providing at least one degree of motion, the multi-element spring including: a principal beam having a proximal end and a distal end, the principal beam separating the proximal end from the distal end, wherein the actuator mount and rotating actuator are securely coupled substantially at the proximal end and the lateral side plate undergoes flexion movement consequential to controlled rotation of the eccentric load; a second beam fixed, through a first substantially rigid hinge, to the distal end of the principal beam, wherein the second beam extends relatively outwardly from the principal beam and wherein the first substantially rigid hinge permits flexion movement of the second beam relative to the principal beam and the second beam further securely holds the clamp and, in use, the mixing container; a third beam fixed, through a second substantially rigid hinge, to a part of the principal beam, the third beam both extending relatively outwardly from the principal beam and in a different orientation relative to orientation of the first substantially rigid hinge, and wherein: outward extension of the third beam increases from the second substantially rigid hinge across a width of the third beam; and the third beam is arranged to permit, when in use and further connected to a stable bracing structure, differing amounts of flexion movement along the second substantially rigid hinge.

In embodiments of the invention, the controller is arranged to operate in at least two phases differentiated between an initial phase that transitions to a kick-phase in which kick-phase an energy profile delivered by parameter control of the rotating actuator is changed significantly relative to that in the initial phase.

The initial phase induces a motion in the assembled container contents in the attached mixing container and the kick phase is arranged to produce a high-speed swirling motion, which may also resemble a vortex, in the assembled container contents. The swirling motion may also be gradually produced.

In embodiment, the controller can be arranged to change rotational speed of the rotating actuator and eccentric load to generate varying rates of swirling. Further selected parameter control of the actuator can include control of at least one of: the duty cycle in a pulse width modulated signal controlling rotation of the rotating actuator and eccentric load; and voltage delivery to a motor of the rotating actuator to affect a change in current through the motor. As described herein, the controller may control operation of the rotating actuator so as to control delivery of energy to the system until full mixing or dissolution of contents within the mixing container is attained.

In described embodiments, the controller is arranged to instantiate an initial phase that induces a chaotic motion by shaking the assembled container contents in the attached mixing container, and then at least a secondary phase that induces swirling motion in the assembled container contents.

Within the various described embodiments, the controller is arranged to operate to control delivery of energy to the mixing device, as delivered by operation of the rotating actuator, which has a function that includes at least one of: a linear variation in delivered energy; an exponential variation in delivered energy; and a non-linear variation in delivered energy.

According to the invention, movement of the assembled container contents represents a secondary eccentric load inducing additional flexion movement through generation of dynamic bending forces within the multi-element spring arising from time-varying loads operating at the proximal end and distal end of the principal beam.

Preferably, the multi-element spring is of unitary construction, such as being molded as a single piece of plastics material.

In another aspect of the invention there is provided a mixing device comprising: a rotating actuator supporting a first eccentric load, the rotating actuator responsive to a control program defining how energy is imparted into the mixing device through time-varying rotation control of the first eccentric load; and a multi-element spring containing a plurality of conjoined beams each providing at least one degree of motion within differing planes of motion for each of the plurality of conjoined beams, and wherein at least one pair of the plurality of conjoined beams is coupled together by a substantially rigid hinge, and wherein one of the plurality of the beams is a backbone having: a first end to which the rotating actuator and the first eccentric load are securely fixed; and a second end remote to the first end and where a clamp for securing, in use, a mixing container, the clamp proximate the second end and separated from the first end; wherein the multi-element spring is arranged to flex in multiple degrees of freedom in response to a combination of active and reactive forces caused and induced by the rotation of the first eccentric load at the first end and a secondary eccentric load held proximate to the clamp, the secondary eccentric load substantially induced by rotation of the first eccentric load and wherein the secondary eccentric load produces reactive force at least partially through the backbone.

A second conjoined beam of the plurality of the beams has variable stiffness longitudinally effective along a length of the substantially rigid hinge connecting the second conjoined beam to the backbone.

Preferably, the second conjoined beam is wedge-shaped.

In a further aspect of the invention, there is provided a mixing system of claim 1 in combination with a sealed vial realising the mixing container, wherein the sealed vial is internally sterile and contains a sterile compound to be dissolved, diluted or suspended in or by a sterile diluent introduced into the vial by means of seal penetration.

In a fourth aspect of the invention there is provided a method of dissolution or homogeneous mixing of a sterile compound or solid into a diluent or liquid introduced into a sterile vial initially containing (a) the sterile compound or sterile solid and (b) gas, the method comprising: generating multiple time-varying dynamic multi-directional flexing in individual elements of a multi-element spring of a mixer to induce a swirling motion of the diluent in the vial, wherein the motion initially in the diluent is produced by selectable motor-driven rotation of a first eccentric load of the mixer at a proximate first end of a first element of the multi-element spring of the mixer whilst the vial is securely fixed at or near a remote second end of the first element, and time-varying dynamic multi-directional flexing within the elements of the multi-element spring is relative to a substantially motionally-stable bracing point to which one element of the multi-element spring is securely fixed; and controllably causing a change in energy to be imparted into the multi-element spring by changing operational parameters of a motor driving said rotation of the first eccentric load to cause at least swirling to form within the diluent in the sterile vial.

In the method, swirling precedes formation of a vortex within contents of the sterile vial. Furthermore, movement of the contents in the vial represents a secondary eccentric load that induces compound flexing through generation of dynamic bending forces within elements of the multi-element spring, said compound flexing arising from at least differing positions for time-varying loads applied at the separated proximal end and distal end of the first element.

In a preferred method of dissolution or homogeneous mixing, mixing is facilitated by comprising causing a change in rotational velocity in the contents in the vial through rotational speed of the first eccentric load. The change in rotational velocity may be caused by at least one of: a change in duty cycle in a pulse width modulated signal controlling rotation of the first eccentric load; and a change in voltage delivered to a motor controlling rotation of the first eccentric load to affect a change in current in the motor. Preferably, the method sees the exercise of controlled delivery of energy to the mixer until mixing or dissolution of contents within the mixing container is attained.

In a yet another aspect of the invention there is provided a method of dissolving or diluting or suspending a compound with a diluent introduced into a mixing container firmly held in a mixer, the method comprising: combining the diluent and compound in the mixing container to produce a mixture; initially shaking or swirling the mixture by dynamically flexing multiple elements of a multi-element spring in different planes of motion, said flexing initially caused by a rotation of a first eccentric load at a first end of a first flexing element of the multi-element spring; by action of said rotation, inducing a complementary secondary flexing in the multi-element spring through swirling or shaking the mixture, the complementary secondary flexing producing a spatially distant second eccentric load at or adjacent to a second end of the first flexing element; and controllably changing motion of the first eccentric load at the first end to cause a change in energy delivered to the mixer.

The mixing container may be one of: an open topped container; a sealable container having a replaceable top or cap; and a pre-sealed container containing contents and wherein the pre-sealed container can be penetrated to introduce the diluent.

In a sixth aspect of the invention there is provided a mixing device comprising: a multi-element spring containing a plurality of conjoined beams each supporting multiple planes of motion, wherein at least one pair of the plurality of conjoined beams is coupled together by a substantially rigid hinge and said at least one pair comprises: a backbone beam having a first end arranged to hold securely a rotating actuator supporting a first eccentric load, and a second end remote to the first end, the second end including a clamp for securing, in use, a mixing container; and a reference beam conjoined to the backbone beam along a substantially rigid hinge, wherein the reference beam extends relatively outwardly from the backbone beam and the reference beam has variable stiffness longitudinally effective along the substantially rigid hinge, wherein the multi-element spring is arranged to flex in multiple degrees of freedom in response to a combination of complementary forces arising from rotation of the first eccentric load and a secondary eccentric load held in the clamp, the secondary eccentric load substantially arising in response to rotation of the first eccentric load.

The reference beam may be inclined relative to the backbone beam by angle in the range of about five degrees to about ninety degrees. The angle is dependent upon the variable stiffness of the reference beam. In a preferred arrangement, the relative movement of the reference beam to the backbone beam is differential. In one or more embodiment described herein, the reference beam is comprised from a plurality of discrete elements having different stiffnesses.

Optionally, at least one of the plurality of conjoined beams can include one or more material reliefs defining varying geometry within or at the surface of the beam. The material relief is at least one of: an edge cut-out; a hole; a channel; variable length; and variable thickness.

In a seventh aspect of the invention there is provided a mixing device comprising: a rotating actuator carrying an eccentric load; a controller exercising parameter control of the rotating actuator to control energy provided, at least in part, into the mixing device through controlled rotation of the eccentric load; a mount configured to hold the rotating actuator; a clamp configured to hold a mixing container representing a mass, when in use the mixing container includes at least one liquid as part of assembled container contents; a multi-element spring containing a plurality of conjoined beams each providing at least one degree of motion, the multi-element spring including: a principal beam having a proximal end, a distal end and a bottom edge, wherein the mount and rotating actuator are securely coupled substantially at the proximal end of the principal beam; a second beam fixed, through a first substantially rigid hinge, to the distal end of the principal beam, wherein the second beam extends relatively outwardly from the principal beam and wherein the first substantially rigid hinge permits flexion movement of the second beam relative to the principal beam and the second beam further holds the clamp; and a third beam fixed, through a second substantially rigid hinge, to a part of the bottom edge of the principal beam, the third beam extending relatively outwardly from the principal beam, and wherein: outward extension of the third beam increases from the second substantially rigid hinge across a width of the third beam; and the third beam is arranged to permit, when in use and further connected to a stable bracing structure, differing amounts of flexion movement along the second substantially rigid hinge.

There is also disclosed herein a mixing system comprising the mixing device of the various aspects (and numerous preferred embodiments), wherein the second conjoined beam is securely fixed to a stable reference structure and the second conjoined beam, in use, is arranged to flex relative to the stable reference structure.

In broad term, an aspect of the present invention relates to a system for mixing or dissolving one or more ingredient(s) or compounds with a liquid, the system comprising: a container holding said one or more ingredient(s) or compounds and the liquid; a mixer having: (a) a plurality of beams each interconnected by a substantially rigid hinge wherein a combination of beams and hinges form a multi-element spring in which, under applied motor-induced forces, at least: some of said plurality of beams flex or bend in one or more planes of motion, and some of said plurality of beams undergo relative angular displacement or relative linear displacement in differing planes of motion for said beams; and (b) two eccentric loads located remote from each other but attached to the multi-element spring, wherein: a first eccentric load is an eccentric mass on a rotor of a controllable motor; and a second eccentric load is created by agitation of said one or more ingredient(s) or compounds and the liquid, said agitation following flexing and displacement of the plurality of cantilever beams consequential of motor-induced forces introduced into the multi-element spring by controlled operation of the motor.

Advantageously, the present invention in its various guises and embodiments provides a mixer that can achieve dissolution/homogenous mixing more rapidly, and generally better mixing for medicament preparations and other small volume emulsions or solutions. The concepts of the present invention, however, may be scaled for larger volume mixing.

The present invention thus provides a new and improved mixer. Generally speaking, the mixer includes a combination of connected sprung beams or cantilevers connected through substantially rigid hinges, with the structure preferably manufactured as a one-piece integral molding. The mixer is driven by a motor with an eccentric load that, upon rotation, induces twisting and flexing forces through the entirety of the multi-element spring. A portion of the spring system is however adapted to be braced. The beams produce multi-plane/multiple degrees of movements within the multi-element spring which, when in use, translate to the contents of, for example, a vial which is capable of being firmly but removably attached to the mixer. Hence, when in use, the contents of the vial undergo mixing where the nature and direction of the mixing is governed by the multiple plane/multiple degrees of freedom of motion.

Once movement is induced in the content (from the sum of flexing forces induced by programmable operation of the motor and movement of the eccentric load), the moving contents act as a complementary (reinforcing or destructive) secondary eccentric load. The system thus experiences complementary and reinforcing twisting forces emanating from the vial which further complicate the movement within the multi-element spring. A second trigger event, controlled by operation of the motor, can be employed to induce, in the limit, the formation of a vortex in the contents of the vial. The overall arrangement has been proven to establish effective mixing.

Depending on the forces generated by the rotation of motor shaft and associated eccentric mass on the rotor, the combination of forces resulting from moving the contents within the vial/container and the forces generated by arrangement of the sprung beams, a number of generally recognisable fluidic motions can be achieved within the vial. The recognisable fluidic motions include at least shaking, vibrating, swirling and vortex.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Exemplary embodiments of the present invention will now be described with reference to the accompanying drawings, in which:

FIGS. 6*a*, 6*b* and 6*c* show different perspective and exploded views of a mixing device according to a second alternative structural arrangement;

DETAILED DESCRIPTION OF A PREFERRED EMBODIMENT

Figure 1B:
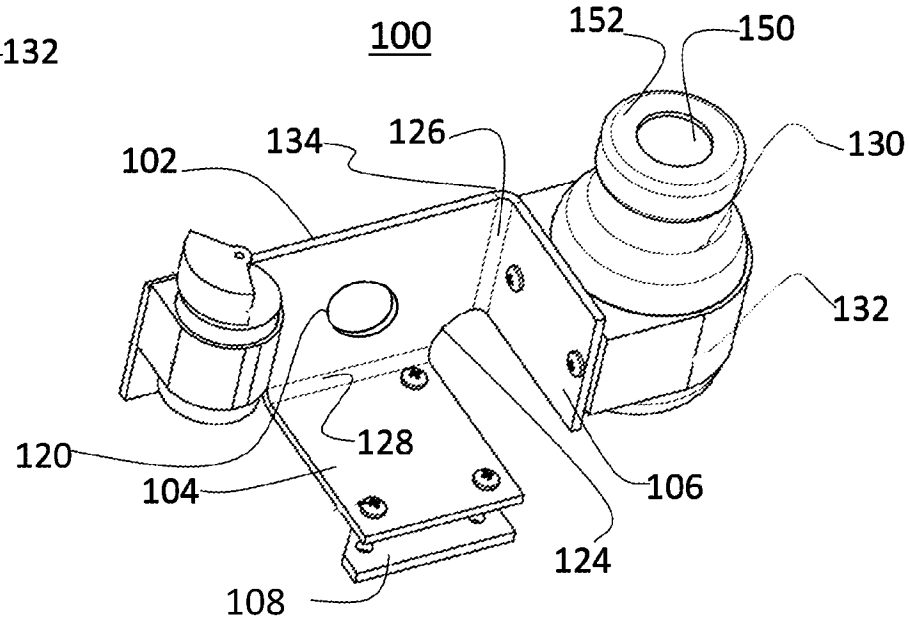
FIGS. 1*a* and 1*b* show different perspective views of a mixing device according to a preferred embodiment of the present invention.
Figure 1A:
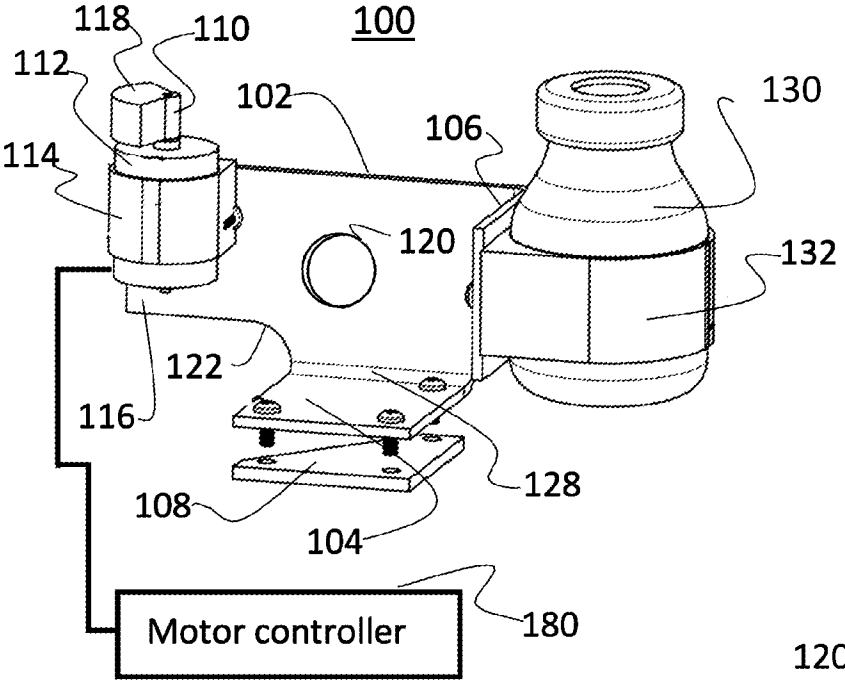
Figures 2, 3:
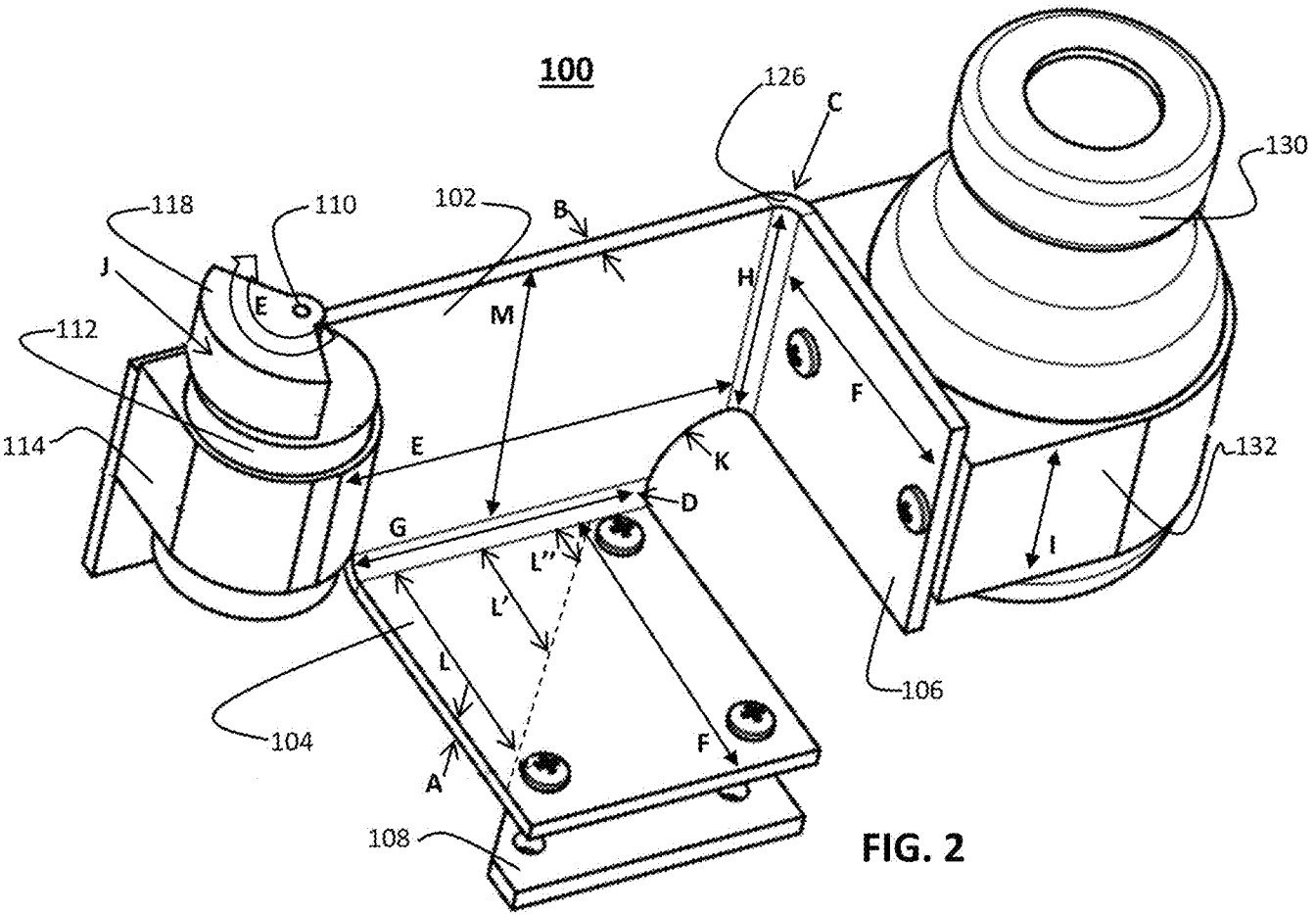
FIGS. 2 and 3 which show and reflect dimensionality for a working example of the mixing device of FIGS. 1*a* and 1*b;*

Referring to FIGS. 1*a* and 1*b* which show different perspective views of a mixing device 100 according to a preferred embodiment of the present invention, and also referring to FIGS. 2 and 3 which show and reflect typical but approximate dimensionality for various components (and thus typical dimensional ratios) for an established working example of the mixing device embodying the concepts of the invention.

The mixing device 100 is based around the flexing interaction of multiple (at least two and typically three) beams 102-106 in different planes of motion relative to a fixed anchor point 108, such as a heavy stable block or other bracing structure. Such flexing, which results in relative displacement between beams as well as twisting distortion in a plane of one or more cantilever beams, is initially produced by controlled rotation of a rotor 110 of a motor 112 that is securely fixed, via a clamp 114 or the like, at or towards a first end 116 of a first cantilever beam 102 (also termed the "backbone 102" or "principal beam 102"). The rotor 110 supports, i.e., carries, an eccentric load 118. The interconnected cantilever beams 102-106 therefore realise a multi-element spring.

The backbone 102 can be considered to have a shape, such as a generally rectangular shape. Although it can include edge cut-outs 122-124, typically radial in shape, along peripheral edges of the backbone 102 and, optionally, weight-saving and/or strength reducing cut-outs 120 within its area. However, the shape is a design option and the shape may be generally symmetrical or may have asymmetrical features. The edge cut-outs 122-124 define a point of connection of the backbone 102 to other flexible beams, namely (1) at least a laterally extending lateral beam (or reference beam) 104 that projects outwardly from or near a lower or bottom edge of the backbone, and (2) and an optional but generally preferably present support beam 106 that also extends generally outwardly and away from the backbone 102, which extends from a second end 134 of the backbone 102 and which has a different orientation (i.e., it is inclined if not tangential) to that of the lateral beam 104. The first and second ends of the backbone therefore define a length of the backbone 102 between proximal and remote ends thereof.

The point of connection between the backbone 102 and the respective lateral beam 104 and support beam 106 is through a respective substantially rigid hinge 126-128. For reasons of clarification, "substantially rigid" means that the hinge is generally stable although flexing or twisting can be induced in or along the length of the hinge when sufficient forces are introduced into the elements that make up the multi-element spring. The respective substantially rigid hinges 126-128 permit flexion movement of their respective beams relative to the backbone 102.

The support beam 106 permits the secure mounting of a container, such as a vial 130, to the support beam 106 through a suitable clamp 132. Mounting is generally central along the support beam 106, but the precise position is a design option. The reason why the support beam is options is that the vial 130 could, in one embodiment, simply be fixed to the second end 134, via a suitable clamp or end loop, although such a fixing reduces overall movement of the vial 130, provides no physical support of the vial 132 but reduces overall mass and complexity of the mixing device 100. The support beam 106 is, in the exemplary embodiment of FIGS. 1*a* and 1*b* and 2, shown to be generally square in shape but other shapes are possible, including those with corner cut-outs that may, for example, define the hinged connection to part of the backbone 102.

The lateral beam 104 may extend substantially tangentially from a plane of the backbone 102, but alternative the lateral beam may be angularly inclined (and not ostensibly at right-angles to the backbone 102). To introduce flexing and movement into and of the backbone 102 and lateral beam 104, the lateral beam 104 may be realised as a variable length cantilever in which bending forces across a width of the beam vary. The lateral beam 104 may therefore, as shown particularly well in FIG. 1*b*, be realised as a generally rectangular plate that is fixedly attached, such as with diagonally displaced screws or the functional equivalent, to an underlying triangularly shaped anchor point 108 or other suitably shaped stable anchor. For example, the area of contact between the bracing structure and the lateral beam 104 can be triangular where the two sides of the triangle are two sides of the lateral beam, and the hypotenuse of the triangle bisects the lateral beam from one corner to another. This is shown by the varying length arrows L. L' to L" of the lateral beam 104 of FIG. 2. The amount of flexing movement in the lateral beam 104 thus increase across the width of the beam as a consequence of the geometry and its interconnection to the anchor point 107. As such, the lateral beam [or any functionally equivalent structure, such as an arc) is arranged to permit, when in use and further connected to a stable bracing structure, differing amounts of flexion movement along the substantially rigid hinge that connects the lateral beam 104 to the backbone 102. The bracing structure, supporting the anchor point, may be a stand or base for the mixing device. Flexing of the lateral beam can be achieved by having an area of contact between the bracing structure that is smaller than the third beam. The area of contact can be shaped to modify the degree and orientation of flexion.

The lateral beam 104 of FIGS. 1*a*, 1*b* and 2 is thus a variable length cantilever, and under varyingly applied directional forces supports movement of the multi-element spring/mixer in different planes of motion relative to other structure features (such as the support beam) of the multi-element spring. And all bending forces within the multi-element spring are relative to the motional stability of the bracing structure/anchor point 108. Although not shown although previously implied (in FIGS. 1*a* and 1*b*), for a sterile system a diluent may be loaded into a syringe and then introduced into the interior of the [glass] vial 130 by having the syringe's needle puncture a self-sealing butyl membrane 150 set within a foil cap 152 (of FIG. 1*b*).

Figure 5:
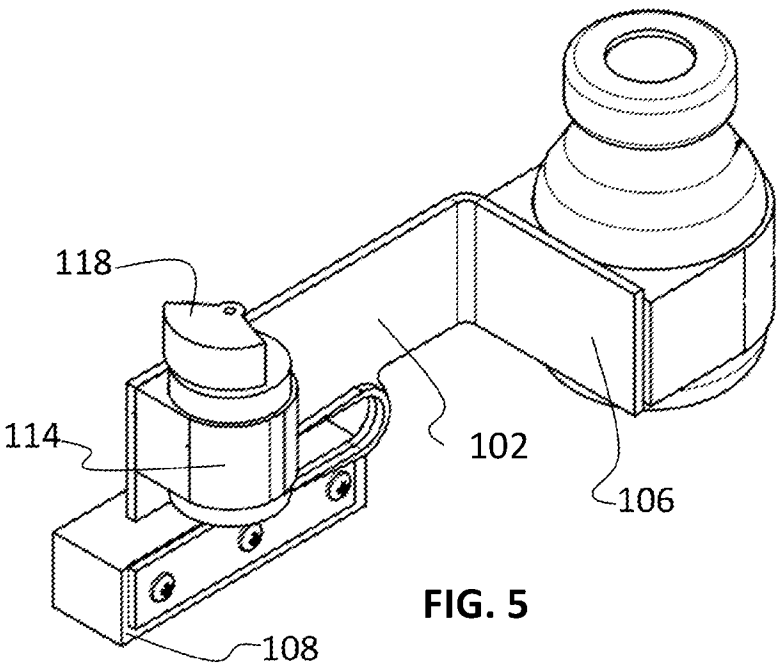
FIGS. 4 and 5 show different perspective views of a mixing device according to a first alternative structural arrangement.
Figure 4:
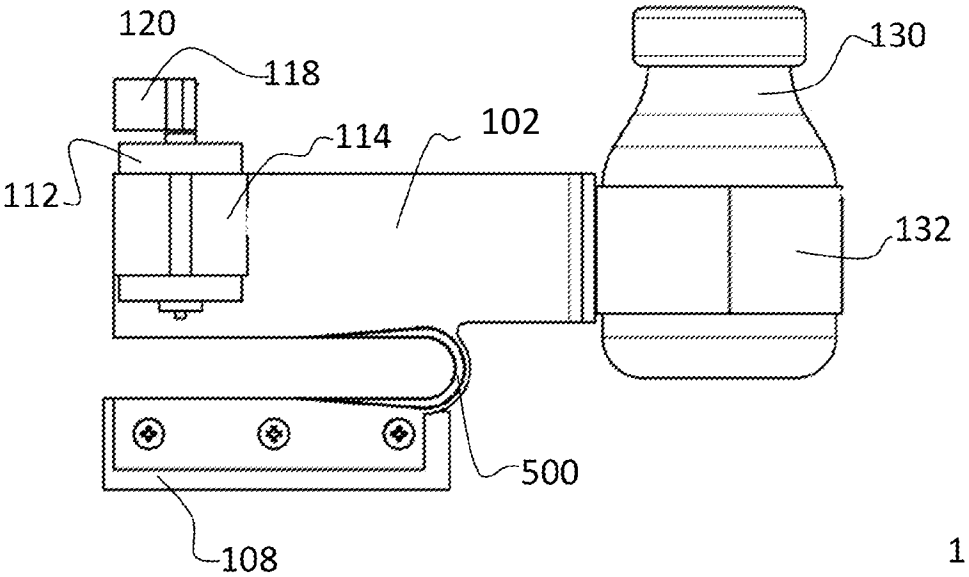
Figure 7A:
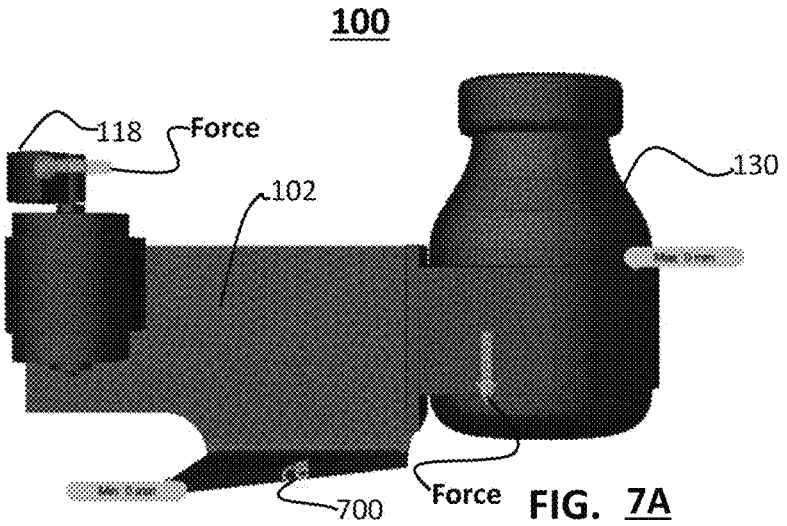
FIGS. 7*a* to 7*c*, 8*a* to 8*c* and 9*a* to 9*c* show an FEA approximation, over time and under applied directional force, in relative movement of the various components, beams and hinges of respectively the mixer system and the multi-element spring of FIG. 2.
Figure 7B:
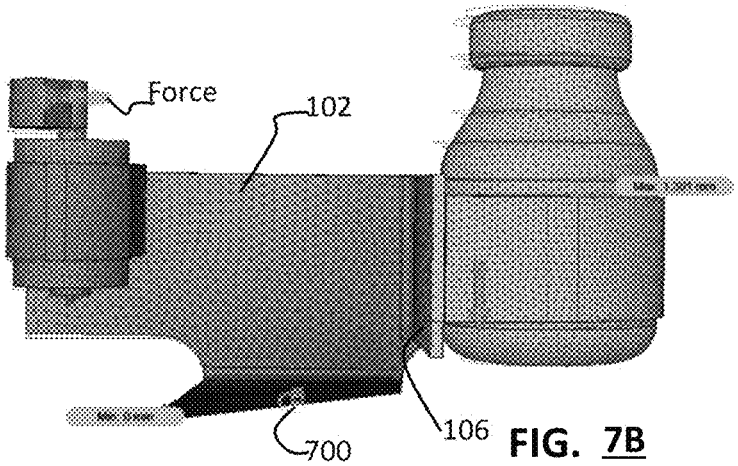
Figure 7C:
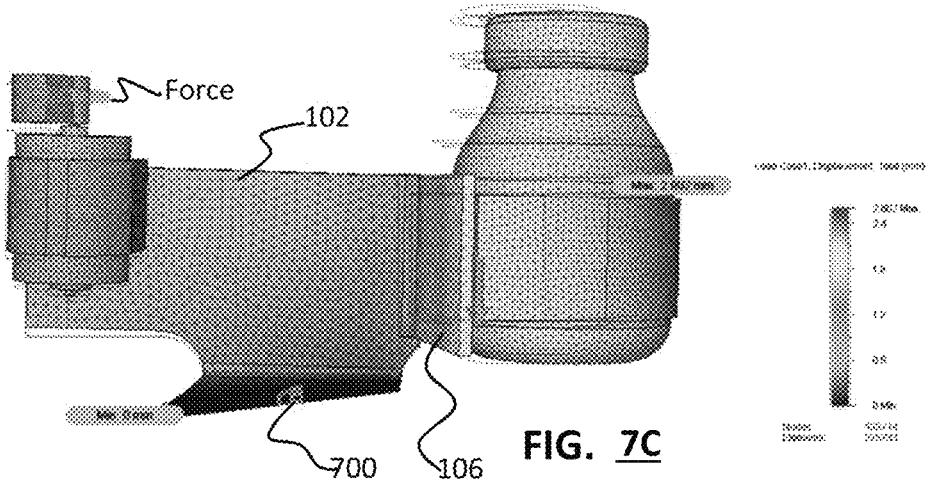
Figure 8A:
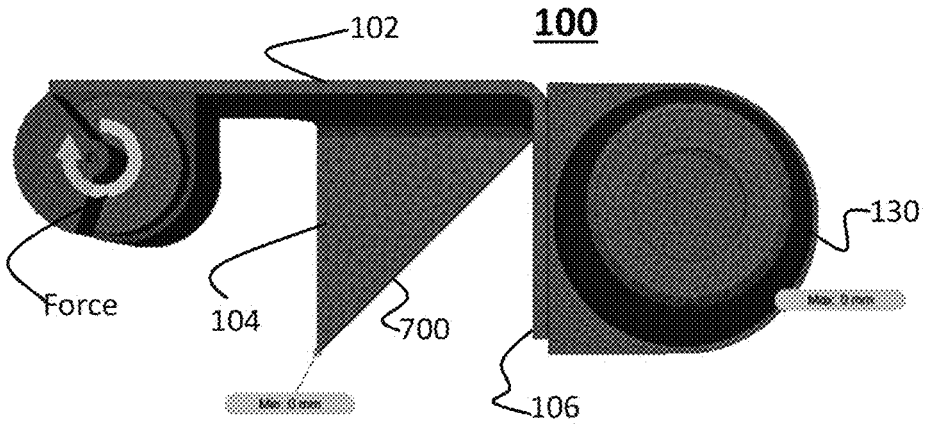
Figure 8B:
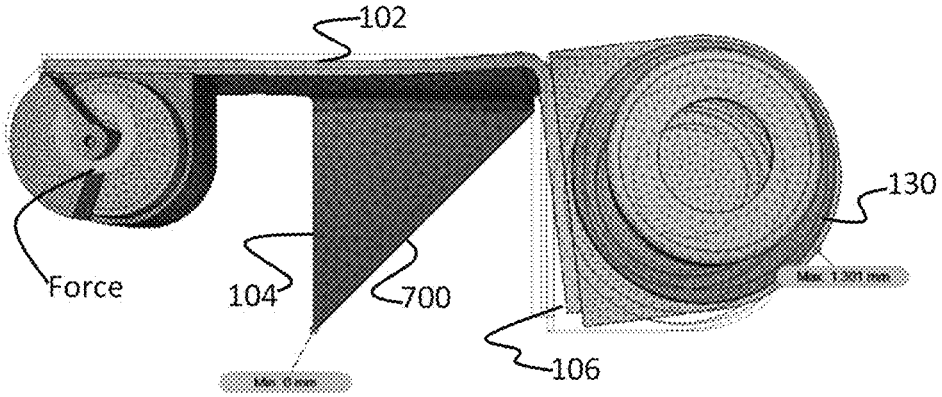
Figure 8C:
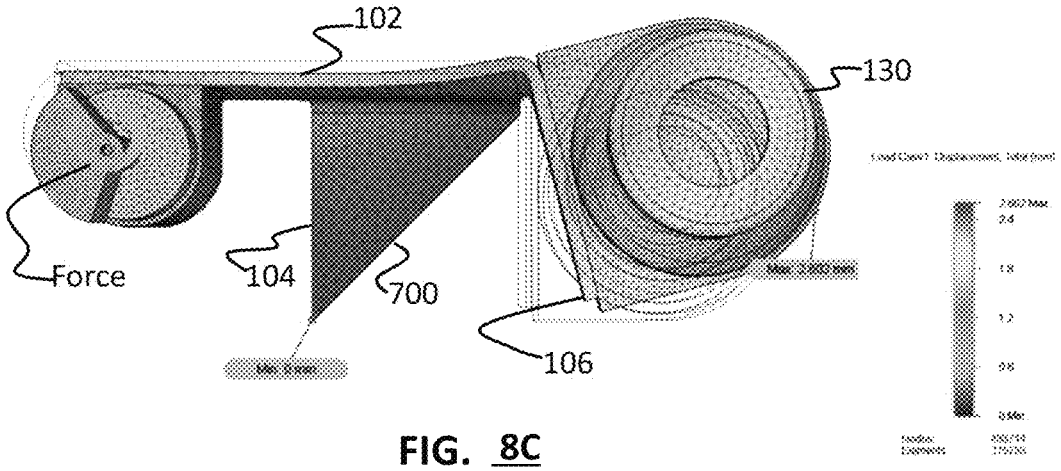
Figure 9A:
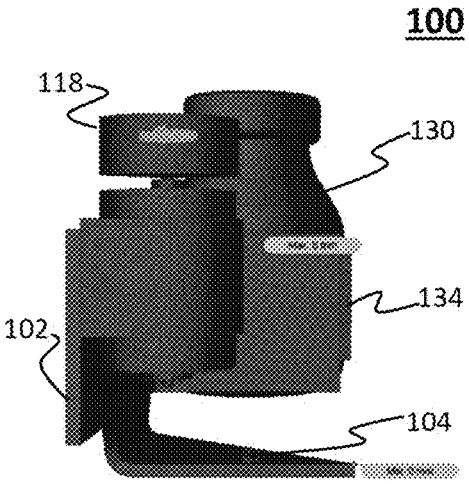
Figure 9B:
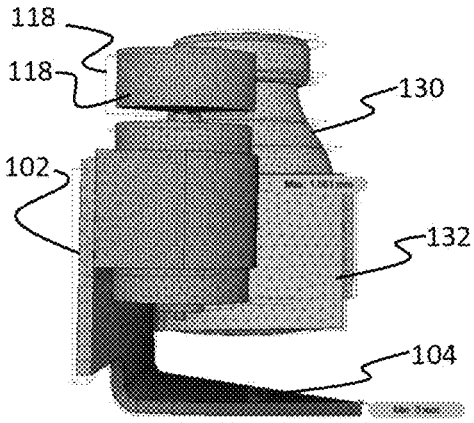
Figure 9C:
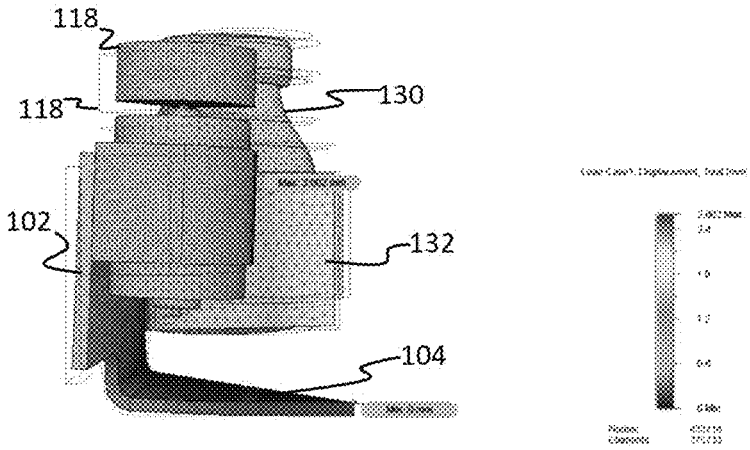
Figure 10A:
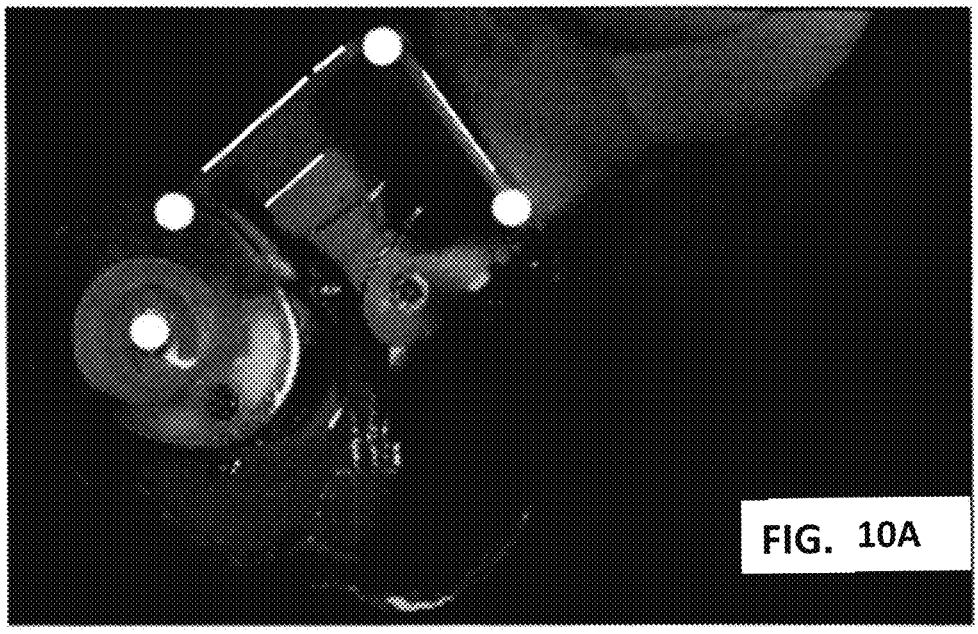
FIGS. 10*a* to 10*e* show a succession of photographic images captured using a high-speed digital camera for in-cycle operation of the mixing device manufactured in accordance with the design of FIG. 2.
Figure 10B:
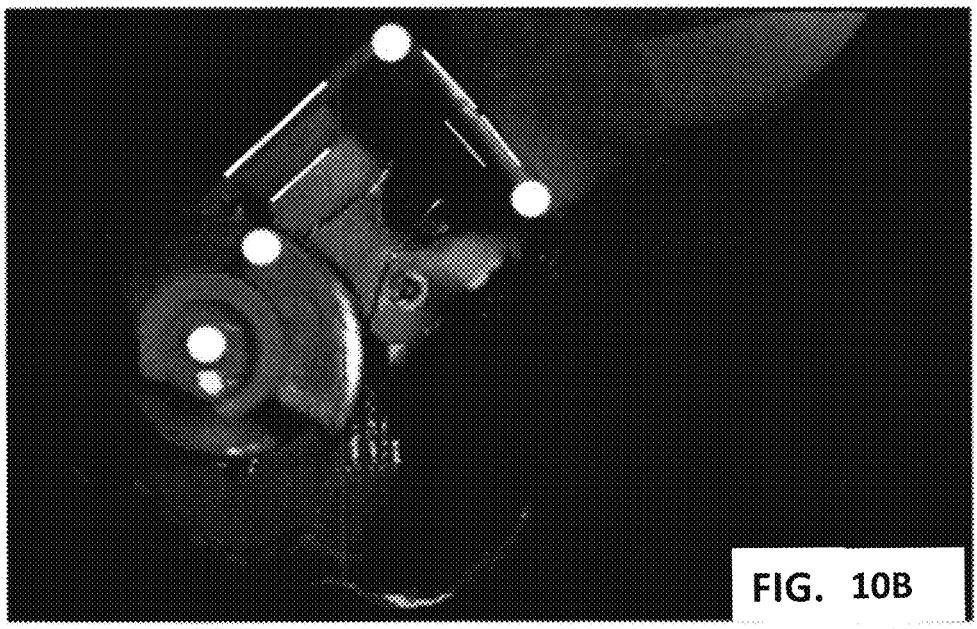
Figure 10C:
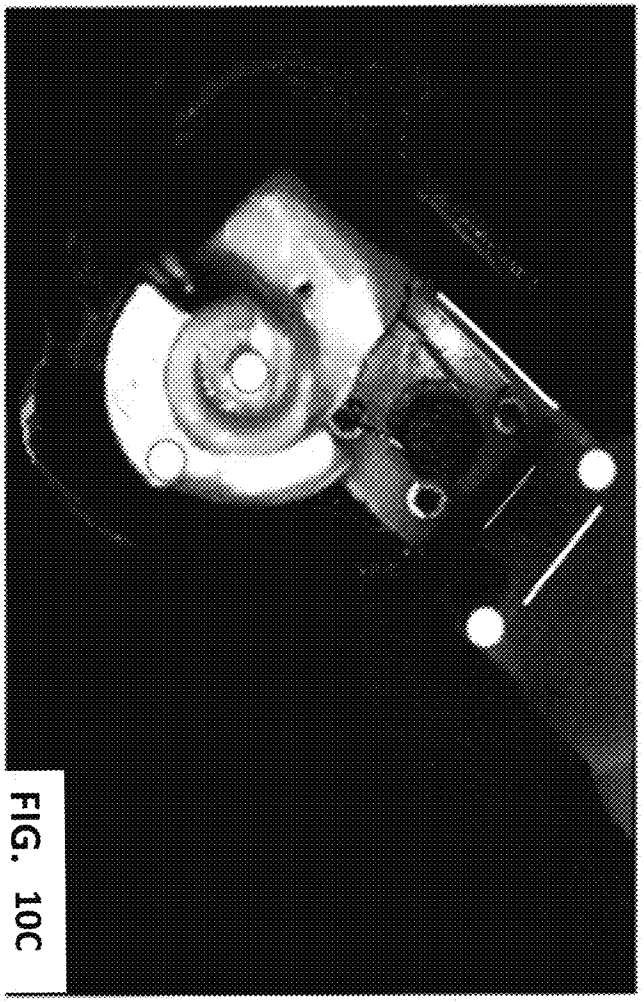
Figure 10D:
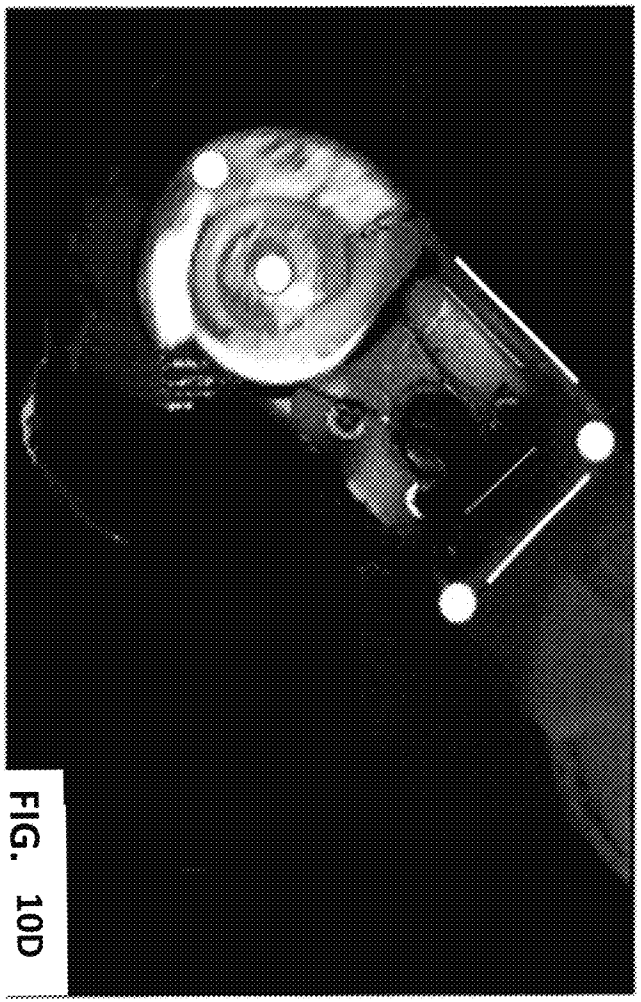
Figure 10E:
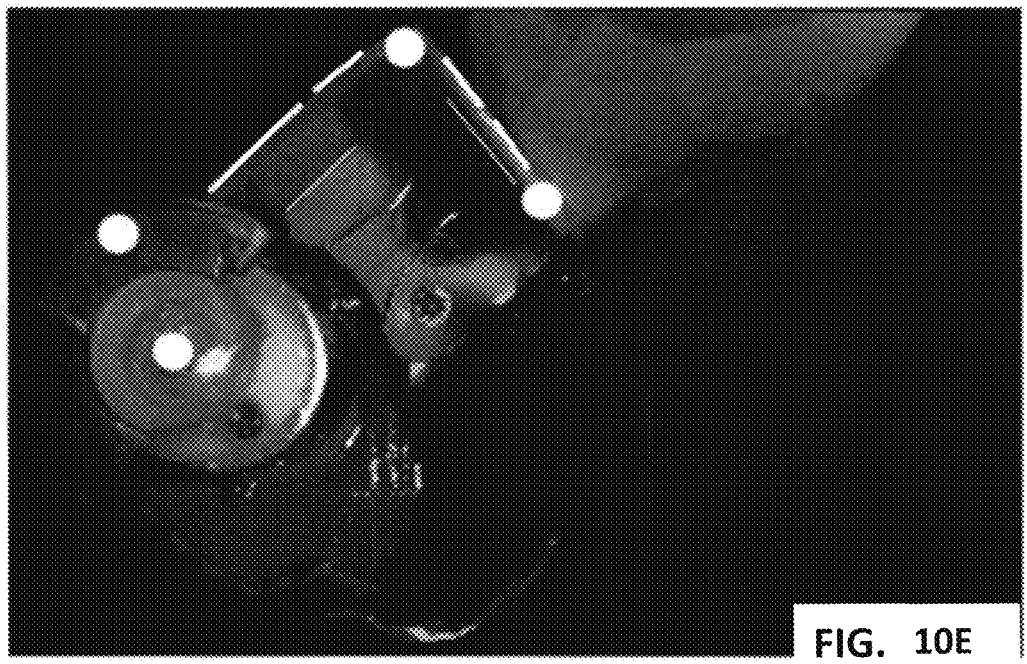
Figures 11A, 11B, 11C, 11D, 11E:
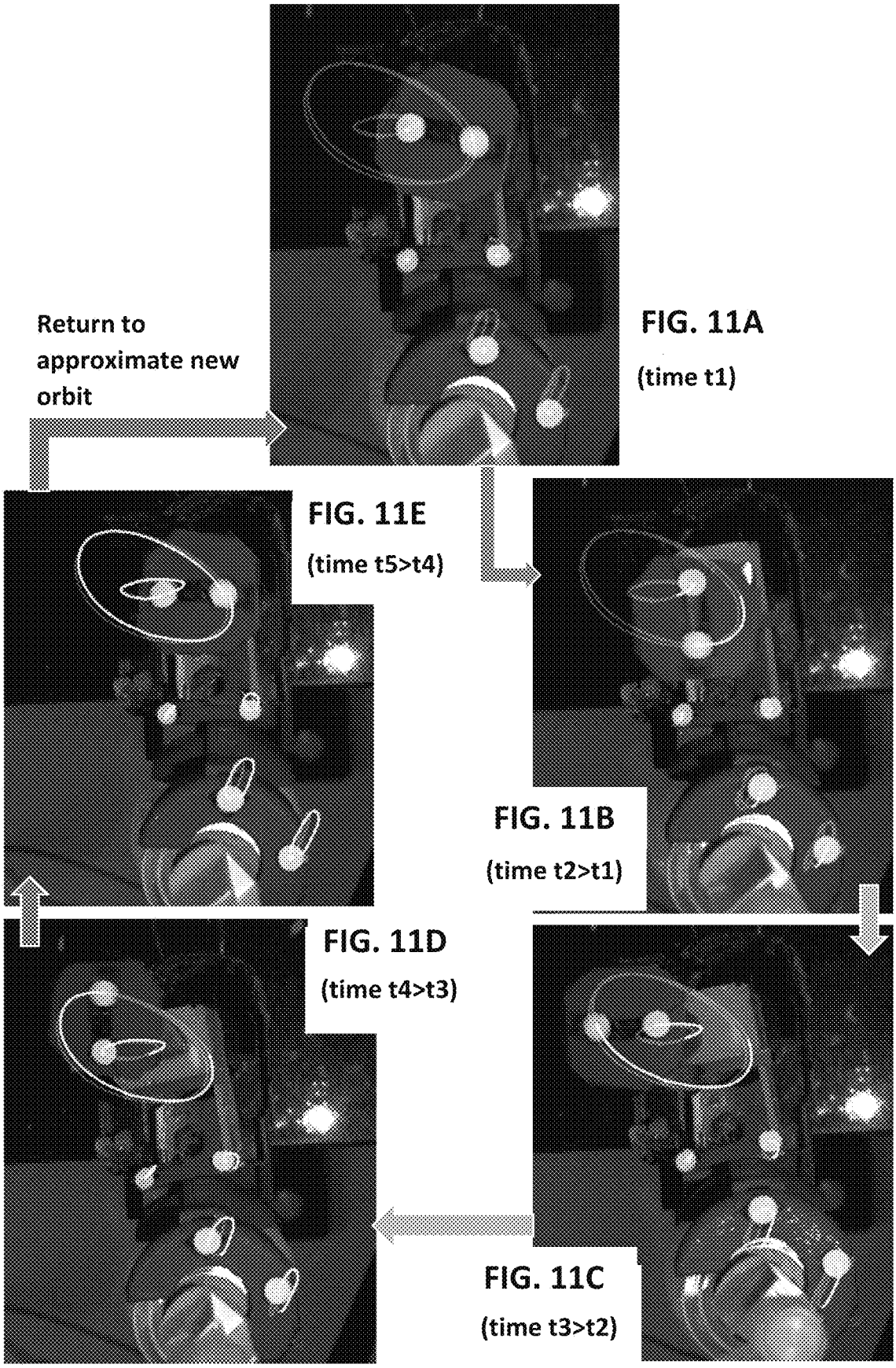
FIGS. 11*a* to 11*e* show a succession captured images on which developing orbital motions for identified features on a mixing device, manufactured in accordance with the design of FIG. 2, have been mapped by tracking software.

The lateral beam of embodiment of, for example, FIGS. 1*a*, 1*b* and 2, may be realised by alternative structures such as a simple spring 500 or a torsion spring configuration 600 604, as respectively shown in the alternative mixer embodiments of FIGS. 4 and 5 (simple spring) and FIGS. 6*a*, 6*b* and 6*c* (torsion spring). Functionally, however, these alternative embodiments function in the same fashion as that FIG. 1*a* and 1*b* since the backbone 102 and support beam 106 both still undergo flexing and/or plane or angular displacement under applied directional forces. The physical shape the stable anchor or bracing point 108 may, however, change given evident connection requirements of the respective simple spring or torsion spring arrangements. The simple spring or torsion spring therefore each provide further motion in the multi-element spring of the mixer, with these movement ability exploited by the arrangement and operation of the eccentric loads from (i) a generated active force from the motor's eccentric load and (ii) a reactive but reinforcing force component arising from consequential agitation and swirling of liquid and/or solid compounds/ingredient in the vial.

With respect to operation of the motor, this is subject to control by a motor controller 160 (referenced in FIG. 1*a*). For a typical medicament mixer, the typical masses for the eccentric load will be in the region of about 30 grams (g) to 40 g. The motor will typically have a body height of about 30 millimetres (mm), and a diameter of 25 mm Although rotational speeds will and indeed are preferably varied during the course of mixing to provide the system with a kick that encourages vortex formation in the contents of the vial, in the example of FIGS. 1*a* and 1*b* (for the exemplary preparation of Tazozin®), rotational speeds are selected to be in the exemplary but typical range of 1 revolution per sec (1 r/sec) to approximately 14 r/s. Whilst not wishing to be bound by theory, this rotation speed depends on the desired fluidic motion, and for other preparations it is also dependant on the load, scale and overall configuration of the multi-element spring of the mixer.

A typical vial mass is the regional of about 90 g to 100 g, including an allowance for 20 ml of water and 4.5 g of powdered medicament. A vial's nominal diameter is 46 mm and its height 73 mm (for a 50 ml Type II glass vial with butyl rubber stopper and aluminium/plastic seal). Vial mixing volumes for medicaments are therefore in the typical range of a few millilitres to a few tens of millilitres. As will be understood by the skilled addressee, scaling to larger volumes requires adequate reinforcement of plane intersections to address the increased force arising from the increased mass in the ingredients that are being mixed together.

Construction of the multi-element spring of the mixer 100 is preferably unitary, such as a molding. Suitable materials for the multi-element spring includes plastics, such as POM (Acetal) and other rigid plastics. A plastic which is suited is polyoxymethylene "POM" (Acetal), other rigid plastics may also be used. Acetal is a common engineering plastic best known for its strength, rigidity, and ability to hold up against a variety of harsh conditions. Other materials that are suitable, as will be appreciated, include metals, metal alloys, carbon or glass fibre composites or hybrid material constructions which exhibit 'spring' characteristics. These include beryllium-copper alloy, titanium alloys, spring steel and titanium.

The material and geometries of multi-element spring, including the substantially rigid hinges, thus provide a stiff and flexible structure that resists deformation and is sufficient robust to permit repeated flexing in multiple planes when placed under varying directional forces. As will be readily appreciated, stiffness relates to how a component bends under load while still returning to its original shape once the load is removed. Applied forces can therefore bend, induce strain and to a degree stretch each of the components of the multi-element spring of mixer of the present invention.

In overview, one or more substantially rigid hinges interconnect the backbone 102 respectively to one or more other cantilevers beams to produce the multi-element spring system. A load, such as a vial or other container containing a mixture of diluent and compound, is located remotely from the motor. The multi-element spring system thus supports two independent but complementary eccentric load generating subsystems arising from, respectively, the controlled rotation of the rotor (and its eccentric load) and then, in response to rotation of the connected eccentric load on the rotor, swirling of the diluent in the vial/container. The effect of the motor eccentric load can be varied by changing at least one of the eccentric mass' position relative to the motor and changing its mass. Both these eccentric loads contribute to a complex multi-directional flexing of the multi-element spring system [relative to a fixed anchor point 108], with this multi-directional flexing works to induce a vortex, i.e., a desirable fluidic motion that enhances mixing, within the contents of the vial. The nature of the mixing is highly complex and does not result in a simple vortex such as might be seen when using a vortex mixer, for example. Indeed, the relative movements of the interconnected beams 102-106, via the substantially rigid hinges 126-128, is highly complex.

It is understood that the multi-element spring arrangement is under a small, biased preload as a result of the positioning of the attached motor (including the driven eccentric mass) and the vial (with enclosed contents). More explicitly, once the mixer is loaded with a vial, the equilibrium state biases the complex spring system such that the system's centre of gravity causes some minor twisting of the backbone 102 along the two substantially rigid hinges 126-128. The motor and vial, under stable conditions, consequently, may be both slightly bent forward and dip to the side, i.e., there is a small angular inclination in both the backbone 102 and the outward extending lateral beam 104 relative respectively to a vertical datum [defined relative to the backbone] and a horizonal datum [defined relative to outward extension of the lateral beam 104]. The effect is that, during motor actuation and active mixing, a random washing motion is initially produced within the contents of the vial since the contents of the vial overcome an additional gravitational force as the angles of inclination of the various sprung beams are flexed backwards and upwards relative to the vertical and horizontal datums. Eventually, operation of the system results in the system reaching a resonant state where movements in each of the multiple sprung beams of the system become less extreme, but at this point mixing is well underway and a vortex in the contents either formed or close to being formed.

In terms of functional operation of the mixing device of the present invention, the eccentric load 118 on the rotor 110 of the motor 112 is controllably rotated (normally clockwise) to induce forces into the rigidly restrained multi-element spring (relative to the bracing point 108). This causes a motion of the vial and its contents. As the velocity of the eccentric load is programmatically changed (normally increased), the sum of the active and reactive forces (respectively from the moving masses of the motor assembly and vial assembly) and the energy storage within the spring, an elliptical motion of the vial is created [noting that other patterns may be produced although these are observed to have been rarely circular in nature]. The elliptical motion is not normally symmetrical about ellipse axis, and indeed motions at varying points within the multi-element spring are dissimilar (as shown in some of the accompanying drawings). Consequently, the diluent/solid matter in the vial is caused to move, e.g., rotate, swirl, vibrate shake and/or to undergo a generally chaotic washing motion. Once the contents in the vial begin to move and swirl, they produce a secondary eccentric load that changes the magnitude of flexing within the multi-element spring of the mixing device 100. In a preferred secondary phase, to cause the vial contents to reach a resonant state and to induce a vortex or high-speed swirling of the vial contents to occur, the rotational speed of the rotor is modified, thereby adapting controllable input forces to bring about enhanced and different flexing or different cycles of flexing within the multi-element spring.

The controller (reference numeral 180 of FIG. 1*a*) is preferably arranged to operate in accordance with a program having at least two differentiated phases, namely (i) an initial phase that is followed by transition into a so-called "kick-phase" in which an energy profile delivered by parameter control of the rotating actuator is changed significantly relative to that in the initial phase. The initial phase thus induces a swirling motion in the assembled container contents in the attached mixing container and the kick phase generally produces a vortex in the assembled container contents. The controller 180 is thus arranged to change and control rotational speed of the rotating actuator, i.e., the rotor and eccentric load, to generate varying rates of swirling. Moreover, the controller 180 is arranged to instantiate an initial phase that induces a motion by shaking the assembled container contents in the attached mixing container/vial 130, and then at least a secondary phase that induces swirling motion in the assembled container contents as the system approaches and achieves resonance. Movement of the assembled contents in the vial 130 represents a secondary eccentric load that induces additional flexion movement through generation of dynamic bending forces within the multi-element spring arising from time-varying loads operating at the proximal end and distal end of the backbone (or principal) beam 102.

Selected parameter control of motor operation can relate to at least one of: control of the duty cycle in a pulse width modulated signal controlling rotation of the rotor 110 and related eccentric load 118; and voltage delivered to the motor 112 to affect a change in current through the motor.

Motion at a top of the vial, following the kick phase, generally follows an elliptical path. Production of the vortex is caused by the controller establishing a relatively predictive moving state as the system {comprised from the mixing container, multi-element spring and rotating actuator] collectively approaches system resonance.

The controller is preferably arranged to operate to control energy delivery that includes at least one of: a linear variation in delivered energy; a variation in delivered energy; and a non-linear variation in delivered energy. Controlled delivery of energy to the system is maintained until full mixing or dissolution of contents within the vial 130 or other mixing container is attained.

The practical upshot of the new mixer design of the various embodiments is that, in the entirely exemplary case of preparation of an eye clear state for the drug Tazozin®, reconstitution is achieved in about ninety seconds. This contrasts to the twelve or so minutes required under current standard manual mixing practices. Of course, other drugs and mixtures, including but not limited to body-building drink supplements and varnishes, scan be more effectively reconstituted or made using the new mixing device.

Referring to FIGS. 7*a* to 7*c*, 8*a* to 8*c* and 9*a* to 9*c*, these figures show an approximation of movement of the various components and beams and hinges of respectively the mixer system and the multi-element spring. The images are presented using finite element analysis "FEA" relative to a "locked position" at the interface of the lateral beam 106 and bracing point(s) on the support structure. Although modelled from the sole perspective of a ninety-degree (90°) revolution of the eccentric mass 118 on the motor (and not from the additional perspective of the secondary eccentric load from the vial), the FEA shows a succession (especially noticeably in relation to the "b" and "c" parts of FIGS. 7 to 9) of overlaid relative displacements of the beams 102-106, hinges 126-128 and vial 130. Overlaid line images and variation in shading and intensity levels both reflect displacement. It is noted, however, that the FEA representations are only indicative of motions and bending potential within the system of the invention. FIGS. 7 to 9 are thus neither qualitative nor quantitative since the FEA representations are dependent on the parameters used and, in this case, should be treated as a primitive first approximation in movement not least because, as will be appreciated, FEA modelling on multiple separate eccentric load conditions is highly complex.

The FEA of FIGS. 7*a* to 9*c* does, however, reinforce the nature of the motions in the mixer of the invention, with FIGS. 10*a* to 10*e* showing in-cycle operation of the mixing device in a succession of photographic images captured using a high-speed, five hundred frames per second camera. In FIGS. 10*a* to 10*e*, a central white circular dot has been introduced to mark both the rotor position and also the centre of the eccentric load 118 on the rotor 110. Both the rotor position and the centre position of the eccentric mass are shown to change from an in-cycle, under load, rotating operational point for the eccentric mass at approximately 12 o'clock, through its later positions at approximately 1 o'clock, 5 o'clock, 7 o'clock and 11 o'clock. Additionally, circular markers at a remote tip of the support beam 106 and above the substantially rigid hinge that connects the backbone 102 to the support beam 106, as well as line markers for top and bottom edges of the backbone 102 and support beam 106 show, as a consequence of relative movement between these line markers, distortion in the planes of those beams as well as twisting and general displacement of the components of the multi-element spring in multiple planes of motion.

FIGS. 11*a* to 11*e* show a succession captured images on which developing orbital motions for identified features on a mixing device, manufactured in accordance with the design of FIG. 2, have been mapped by tracking software. The time-lapsed in-cycle images establish the complex flexing and movement of datums within the overall mixer, including: i) the centre rotor 110; ii) the middle point on the eccentric mass 118 on the rotor; iii) an upper point above the substantially rigid hinge that connects the backbone 102 to the support beam 106; iv) the remote tip of the support beam 106; v) a centre point in a clamp member holding the vial 130 securely to the support beam; and vi) an edge region of the clamp member that is displaced radially from the immediately aforementioned centre point in the vial's clamp member.

The information that can be derived from the succession of tracked orbits in FIGS. 11*a* to 11*e* is that:

i) there are changes in both the relative displacement and orbital motions for each point, including that some orbits are generally elliptical, some somewhat circular, some somewhat linear and the majority of successive orbits offset in space with the passage of time. In the latter respect, relative intensity of the tracking reflects orbital development;

ii) there are relative changes in relative position between different marked points;

iii) developing orbits for near-neighbouring points may be in different orientations, i.e., a first orbit for the centre of the rotor is anti-clockwise whereas the orbit for middle point on the eccentric mass 118 develops in a clockwise fashion; and iv) successive orbits may be different in that they have one or more cross-over point(s). The system is not in exact harmonious operation.

FIGS. 11*a* to 11*e* thus confirm that the complex flexing nature between interacting aspects of the multi-element spring of the mixing device of the invention and reflects that differential directional forces of different magnitudes arise within the mixer to produce effective mixing (of a medicament, varnish, paint, soluble food preparation or whatever).

Unless specific arrangements are mutually exclusive with one another, the various embodiments described herein can be combined to enhance system functionality and/or to produce complementary functions or system that support the effective identification of user-perceivable similarities and dissimilarities. Such combinations will be readily appreciated by the skilled addressee given the totality of the foregoing description. Likewise, aspects of the preferred embodiments may be implemented in standalone arrangements where more limited functional arrangements are appropriate. Indeed, it will be understood that unless features in the particular preferred embodiments are expressly identified as incompatible with one another or the surrounding context implies that they are mutually exclusive and not readily combinable in a complementary and/or supportive sense, the totality of this disclosure contemplates and envisions that specific features of those complementary embodiments can be selectively combined to provide one or more comprehensive, but slightly different, technical solutions that each realise cyclonic mixing with the sealed mixing basin. In terms of any suggested process flows related to operation of the designs shown in the accompanying exemplary drawings, it may be that these can be varied in terms of the precise points of execution for steps within the process so long as the overall effect or re-ordering achieves the same objective end results or important intermediate results that allow advancement to the next logical step. The flow processes are therefore logical in nature rather than absolute.

Supporting aspects of the various embodiments of the invention may be provided in a downloadable form or otherwise on a computer readable medium, such as a CD ROM, which contains program code that, when instantiated, executes the link embedding functionality at a webserver or the like. For example, specific mixing control algorithms for specific compounds may be selected from a local library or downloaded. Such control algorithms may define discrete timing transitions between mixing phases, including changes that affect rotational speeds of the eccentric weight to affect energy profiles for energy delivered into the system.

It will, of course, be appreciated that the above description has been given by way of example only and that modifications in detail may be made within the scope of the present invention. For example, geometries in connecting structures between abutting mixing planes can include edge cut-outs having curved profiles that reduce the physical size of material through which forces pass from one component to the next. Additionally, the various cantilevers can include cut-outs to reduce overall weight. Dimensionality, such as overall lengths of the beams, the length of the substantially rigid hinges, the nature of the material in terms of composition (plastic, such as polypropylene, or metals) and uniform of varying thickness can be adjusted to tune the resultant system to a particular application. Indeed, compensatory changes between interacting components of the multi-element spring allow, as will be understood, dimensions of one component to be altered, i.e., offset, at the expense of dimensions in another component whilst still achieving the same mixing affect. In other words, ratios of component dimensionality may change, and relative angular displacement can thus be affected whilst the resultant multi-element spring still achieves desirable vortex generation.

Tuning of the system may, for example, be achieved either by controlled energy delivery by the motor and/or by altering the mass or position of the mass of the eccentric mass on the rotor. In other words, the eccentric load on the rotating actuator may be a variable eccentric load.

However, refined tuning of the physical parameter that affect specific flexing of the various beams and hinges [that realise the multi-element spring of the mixer] to optimise the mixer for a particular application can lead to a de-tuned mixer for different applications, e.g., different medicaments. In this respect, mixing performance may be tuned based on a generic physical structure and then honed for a specific application through selection of (i) active control of rotational speeds of the motor and/or (ii) selected mass of the eccentric mass on the motor, and/or (iii) mass and/or position of the vial/container, and/or (iv) selected position of the eccentric weight fixed to the shaft of the motor. As will be appreciated, energy developed by rotational velocities and rotational forces can be used to affect flexing of the various sprung beams.

Dimensionality of the principal dimensions for the various cantilever beams and related hinges (as well as positioning of one or more of the eccentric load and vial/container) are therefore exemplary. The dimensions shown in the table of FIG. 3 represent in tuned system particularly suitable for the preparation and mixing of mixing Tazozin® (a notoriously difficult composition to mix to a water-clear state). Variations in dimensionality, such as lengths and thicknesses of the backbone 102, radii for cut-out 124 and weight and position of eccentric load 118, thus are not limiting so long as the principles in the bi-loading of the multi-element, multi-spring system with eccentric generators, as described herein, are observed. Indeed, thicknesses of the various features and the materials selected for manufacture of the various components of the mixer device are to a degree dependant on the loads and physical scale of the mixing device. The skilled addressee will therefore appreciate this statement and observe the dimensions in the table of FIG. 3 may be varied and, indeed, that flexibility and thus relative movement in one component may be deliberately offset against flexibility in another interacting component.

The important aspects remain consistent regardless, namely that there are multiple degrees of freedom of movement inducible in the pre-loaded multi-element spring system of the mixer, and the spring system supports two independent but complementary eccentric load generating subsystems, namely the eccentrically loaded motor and the relatively remotely located contents in the vial/container.

In the latter respect, whilst not wishing to be bound by theory, it is understood that eccentricity induced by the vial/container and its load is brought into the system by (i) a relative change in the centre of gravity of the vial/container and its contents with respect to the overall multi-element spring mixer, and/or (ii) the forces required to overcome the action of gravity that otherwise resists the movement of the contents backwards [in the direction of the backbone] relative to a stationary steady-state position for the contents.

Furthermore, whilst the foregoing description has concentrated on the exemplary mixing of a medicament in a sterile vial and particularly (but not exclusively) on a mixing solution for Tazozin®, the structural concepts of the multi-spring element mixer can be applied to mix or produce a cream or emulsion. In the mixing of emulsions, the limiting factor will be the viscosity of the emulsion. The present invention is, in fact, able to mix any combinations of liquid and solid, dissimilar liquids and combinations of multiple solids/liquids.

The invention claimed is:

1. A mixing device comprising:

a rotating actuator carrying an eccentric load;

a controller exercising parameter control defining operation of the rotating actuator and instantaneous amounts of energy provided to the mixing device through controlled rotation of the eccentric load;

a mount configured to hold securely the rotating actuator;

a clamp configured to hold a mixing container representing a mass, wherein the mixing container includes at least one liquid as part of assembled container contents;

a multi-element spring containing a plurality of conjoined beams providing a plurality of degrees of motion, the multi-element spring including:

a principal beam having a proximal end and a distal end, wherein the mount and rotating actuator are securely coupled substantially at or near the proximal end, and the principal beam is arranged to undergo flexion movement consequential to controlled rotation of the eccentric load;

a second beam fixed, through a first substantially rigid connection, to the distal end of the principal beam, wherein the second beam extends relatively outwardly from the principal beam and wherein the first substantially rigid connection permits flexion movement of the second beam relative to the principal beam and the second beam further securely holds the clamp and, in use, the mixing container;

a third beam fixed, through a second substantially rigid connection, to a part of the principal beam, the third beam both extending relatively outwardly from the principal beam and in a different orientation relative to orientation of the first substantially rigid connection, the third beam arranged to permit, when in use and further connected to a stable bracing structure, differing amounts of flexion movement relative to the stable bracing structure, and wherein:

at least two of:

the principal beam;

the second beam;

the third beam;

the mount;

the first substantially rigid connection;

the second substantially rigid connection; and the multi-element spring;

are formed in a unitary construction.

2. The mixing device of claim 1, wherein mixing performance is tuned based on at least one of:

active control of rotational speeds of the rotating actuator;

selected mass of the eccentric load on the rotating actuator;

mass of the clamp;

position of the clamp;

mass of the mount;

position of the mount;

mass of the mixing container;

position of the mixing container;

mass of the assembled container contents;

position of the rotating actuator; and mass of the rotating actuator.

3. The mixing device of claim 1, wherein the controller is arranged controllably to establish production of a vortex-like effect within the assembled container contents, said vortex-like effect arising as a state approximating system resonance is approached caused by a moving state of a system including the mixing container, the multi-element spring, the rotating actuator and the assembled container contents.

4. The mixing device of claim 1, wherein the controller is arranged to control delivery of energy to the mixing device through controlled operation of the rotating actuator, whereby controlled delivery of energy is a function that is at least one of:

a linear variation in delivered energy;

an exponential variation in delivered energy; and a non-linear variation in delivered energy.

5. The mixing device of claim 1, wherein movement of the assembled container contents represents an eccentric load inducing additional flexion movement to the flexion movement arising from generation of dynamic bending forces within the multi-element spring introduced from time-varying loads operating at or towards the proximal end and at or towards the distal end of the principal beam.

6. The mixing device of claim 1, wherein the controller is arranged to cause a change in rotational velocity in the assembled container contents through selected parameter control, said selected parameter control by the controller affecting speed of rotation of the eccentric load about the rotating actuator.

7. The mixing device of claim 1, wherein the eccentric load of the rotating actuator is a variable eccentric load having at least one of:

a selectable weight;

a selectable shape of the eccentric load;

a selectable position of the of the eccentric load;

a selectable position of the eccentric load relative to an axis of the motor;

a selectable material density of the eccentric load; and a selectable distribution of mass within the eccentric load.

8. The mixing device of claim 1, wherein bending forces within the multi-element spring are relative to motional stability of the stable bracing structure.

9. The mixing device of claim 1, wherein combined resultant forces within the mixing device arising from controlled operation thereof cause the mixing container to move in an approximately predictable cyclical trajectory.

10. The mixing device of claim 1, wherein, in use, combined resultant forces within the mixing device arising from controlled operation thereof cause the mixing container to move in a chaotic trajectory.

11. A mixing device comprising:

a rotating actuator carrying an eccentric load;

a controller exercising parameter control defining operation of the rotating actuator and instantaneous amounts of energy provided to the mixing device through controlled rotation of the eccentric load;

a mount configured to hold securely the rotating actuator;

a clamp configured to hold a mixing container representing a mass, wherein the mixing container includes at least one liquid as part of assembled container contents;

a multi-element spring containing a plurality of conjoined beams providing a plurality of degrees of motion, the multi-element spring including:

a principal beam having a proximal end and a distal end, wherein the mount and rotating actuator are securely coupled substantially at or near the proximal end, and the principal beam is arranged to undergo flexion movement consequential to controlled rotation of the eccentric load;

a second beam fixed, through a first substantially rigid hinge, to the distal end of the principal beam, wherein the second beam extends relatively outwardly from the principal beam and wherein the first substantially rigid hinge permits flexion movement of the second beam relative to the principal beam and the second beam further securely holds the clamp and, in use, the mixing container;

a third beam fixed, through a second substantially rigid hinge, to a part of the principal beam, the third beam both extending relatively outwardly from the principal beam and in a different orientation relative to orientation of the first substantially rigid hinge, the third beam arranged to permit, when in use and further connected to a stable bracing structure, differing amounts of flexion movement relative to the stable bracing structure, and wherein:

at least two of:

the principal beam;

the second beam;
the third beam;
the mount;
the first substantially rigid hinge;
the second substantially rigid hinge; and
the multi-element spring;
are formed in a unitary construction.

12. The mixing device of claim 11, wherein mixing performance is tuned based on at least one of:
active control of rotational speeds of the rotating actuator;
selected mass of the eccentric load on the rotating actuator;
position of eccentric load on the rotating actuator;
mass of the mixing container;
position of the mixing container;
mass of the assembled container contents; and
position of the rotating actuator.

13. The mixing device of claim 11, wherein the controller is arranged to operate in at least two phases differentiated between an initial phase that transitions to a kick-phase in which kick-phase an energy profile delivered by parameter control of the rotating actuator is changed significantly relative to that in the initial phase.

14. The mixing device of claim 13, wherein the initial phase induces a swirling motion in the assembled container contents in the attached mixing container and the kick phase produces an approximation to a vortex in the assembled container contents.

15. The mixing device of claim 11, wherein the controller is arranged to instantiate an initial phase that induces a chaotic motion by shaking the assembled container contents in the attached mixing container, and then at least a secondary phase that induces swirling motion in the assembled container contents.

16. The mixing device of claim 11, wherein production of an approximation to a vortex in the assembled container contents is caused by the controller establishing a relatively predictive moving state as a system including the mixing container, multi-element spring, the rotating actuator and the assembled container contents, collectively approaches system resonance.

17. The mixing device of claim 11, wherein the controller is arranged to operate to control delivery of energy to the mixing device, as delivered by operation of the rotating actuator, that has a function that includes at least one of:
a linear variation in delivered energy;
an exponential variation in delivered energy; and
a non-linear variation in delivered energy.

18. The mixing device of claim 11, wherein movement of the assembled container contents represents an eccentric load inducing additional flexion movement to the flexion movement arising from generation of dynamic bending forces within the multi-element spring introduced from time-varying loads operating at or towards the proximal end and at or towards the distal end of the principal beam.

19. The mixing device of claim 11, wherein the controller is arranged to cause a change in rotational velocity in the assembled container contents through selected parameter control, said selected parameter control by the controller affecting speed of rotation.

20. The mixing device of claim 11, wherein the eccentric load of the rotating actuator is a variable eccentric load having at least one of:
a selectable weight;
a selectable shape of the eccentric load;
a selectable position of the of the eccentric load;
a selectable position of the eccentric load relative to an axis of the motor;
a selectable material density of the eccentric load; and
a selectable distribution of mass within the eccentric load.

21. The mixing device of claim 11, wherein all bending forces within the multi-element spring are relative to motional stability of the stable bracing structure.

22. The mixing device of claim 11, wherein mixing performance is tuned based on at least one of:
active control of rotational speeds of the rotating actuator;
selected mass of the eccentric load on the rotating actuator;
mass of the clamp;
position of the clamp;
mass of the mount;
position of the mount;
mass of the mixing container;
position of the mixing container;
mass of the assembled container contents;
position of the rotating actuator; and
mass of the rotating actuator.

* * * * *